US006921629B2

(12) United States Patent
Linliu et al.

(10) Patent No.: US 6,921,629 B2
(45) Date of Patent: Jul. 26, 2005

(54) SELF-ALIGNED FABRICATION PROCESS FOR A NOZZLE PLATE OF AN INKJET PRINT HEAD

(75) Inventors: Kung Linliu, Hsinchu (TW); Yi-Ren Huang, Hsinchu (TW)

(73) Assignee: Nanodynamics Inc., Hsinchu (TW)

( * ) Notice: Subject to any disclaimer, the term of this patent is extended or adjusted under 35 U.S.C. 154(b) by 0 days.

(21) Appl. No.: 10/667,070

(22) Filed: Sep. 18, 2003

(65) Prior Publication Data

US 2005/0058946 A1 Mar. 17, 2005

(30) Foreign Application Priority Data

Oct. 22, 2002 (TW) ..... 91124329 A

(51) Int. Cl.[7] ..... B41J 2/16
(52) U.S. Cl. ..... 430/320; 216/27; 347/47
(58) Field of Search ..... 430/320; 216/27; 347/47

(56) References Cited

U.S. PATENT DOCUMENTS 5,945,260 A * 8/1999 Miyagawa et al. ..... 430/230
5,983,486 A * 11/1999 Shimomura et al. ..... 29/611
6,773,094 B2 * 8/2004 Linliu et al. ..... 347/71

* cited by examiner

*Primary Examiner*—John A. McPherson
(74) *Attorney, Agent, or Firm*—Thomas, Kayden, Horstemeyer & Risley

(57) ABSTRACT

A self-aligned fabrication process for a nozzle plate of an inkjet print head. A substrate is provided with an activated device and a first film is formed on the substrate. Then, a second film is formed on the first film. Next, the second film is defined to form a convex portion corresponding to the activated device, exposing a part of the surface of the first film. Next, a third film is formed on the exposed surface of the first film, covering the convex portion. The third film on the convex portion is then removed. Next, the convex portion and the first film under the convex portion are etched to form a via.

18 Claims, 4 Drawing Sheets

SELF-ALIGNED FABRICATION PROCESS FOR A NOZZLE PLATE OF AN INKJET PRINT HEAD

BACKGROUND OF THE INVENTION

1. Field of the Invention

The invention relates to a method of forming a nozzle plate of an inkjet print head, and more particularly to a self-aligned fabrication process for a nozzle plate of an inkjet print head.

2. Description of the Related Art

Inkjet printers, accurately and rapidly drive ink droplets of precise volume in predetermined positions to print, and as such satisfy demands for automation, miniaturization, low cost, reduced-time procedures, and environmental concerns in the electronics industry. Particularly, thermal inkjet print heads employ a heater to vaporize ink droplets, and use high-pressure bubbles to drive the ink droplets through nozzle orifices to print. The inkjet print head comprises an ink cartridge, a nozzle plate having a plurality of nozzle orifices and a plurality of thin-film heaters, in which each thin-film heater is disposed under each nozzle orifice and is provided with an ink channel wall to drive ink droplets from corresponding nozzle orifices.

Print quality of the inkjet printer mainly depends on physical characteristics of the nozzle orifice of the inkjet print head, such as the undercut profile and the opening profile of the nozzle orifice, which influence volume, track and jet speed of the ink droplets. Conventionally, the nozzle plate is a metal plate with a plurality of nozzle orifices formed by lithographic electroforming or other electrochemical shaping technologies. However, the metal nozzle plate formed by lithographic electroforming encounters problems. First, the process conditions, such as stress and electroplating thickness, are difficult to control. Second, design choices of nozzle orifice shape and size are limited. Third, the process cost is high for mass production. Fourth, the metal plate is easily corroded by the ink droplets. Although this corrosion phenomenon can be eliminated by electroplating an extra gold layer on the metal nozzle plate, the process cost is concurrently increased.

Recently, an excimer laser treatment has been employed to form the nozzle orifices and solve the above-described problems, but other problems are encountered, such as misalignment, and bulky and expensive facilities.

Accordingly, a novel process of forming the nozzle plate for improved printing quality, simplified process, decreased process costs, and improved pattern precision, is called for.

SUMMARY OF THE INVENTION

Accordingly, an object of the invention is to provide a self-aligned fabrication process for a nozzle plate of an inkjet print head. The position, diameter, and profile of the nozzle orifice are effectively controlled to achieve simplified procedure, reduced cost, and improved precision.

To achieve these and other advantages, the invention provides a self-aligned fabrication process for a nozzle plate of an inkjet print head. First, a substrate is provided with an activated device and a first film is formed on the substrate. Then, a second film is formed on the first film. Next, the second film is defined to form a convex portion corresponding to the activated device, exposing a part of the surface of the first film. Next, a third film is formed on the exposed surface of the first film, covering the convex portion. The third film on the convex portion is then removed. Finally, the convex portion and the first film under the convex portion are etched to form a via.

According to the invention, the nozzles having better performance than nozzles made by conventional electroforming are provided by a simplified fabrication process.

By directly forming nozzle orifices on the substrate, the conventional requirement of precise alignment between the nozzle orifices (on the metal nozzle plate) and the activated devices (on the substrate) in an electroforming step is not required, and yield down resulting from misalignment is prevented.

Moreover, by appropriately selecting the materials of the first film and the third film to be hydrophilic and hydrophobic respectively, the inkjet printing mechanism is facilitated, providing high-resolution inkjet performance.

DESCRIPTION OF THE DRAWINGS

For a better understanding of the present invention, reference is made to a detailed description to be read in conjunction with the accompanying drawings, in which.

DETAILED DESCRIPTION OF THE INVENTION

The present invention provides a self-aligned fabrication process for a nozzle plate of an inkjet print head. On a substrate, laminating, exposure, development, and etching are employed to form a plurality of nozzle orifices in a film, such that the position, diameter, and profile of the nozzle orifices are effectively controlled to simplify the procedure, reduce costs, and improve precision. The amount, arrangement, and size of the nozzle orifices are design choices and not limited.

Two preferred embodiments of the present invention are now described with reference to a method of forming a nozzle orifice over an activated device (for example, a thin-film heater) of a silicon substrate.

First Embodiment

Figure 1A:
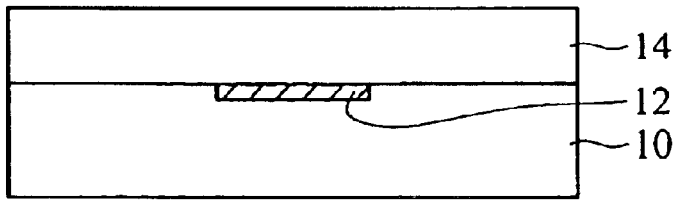
FIGS. 1A to 1F are sectional diagrams of a self-aligned fabrication process for a nozzle plate of an inkjet print head according to the first embodiment.

FIGS. 1A to 1F are sectional diagrams of a self-aligned fabrication process for a nozzle plate of an inkjet print head according to the first embodiment. In FIG. 1A, a silicon substrate 10 is provided with at least one activated device 12, such as a thin-film heater, and then covered with a first film 14 by laminating or any other deposition type. Preferably, the first film 14 is a photosensitive polymeric material, such as epoxy, novolak, arcylate, polyimide, polyamide, or photosensitive polymer.

Figure 1B:
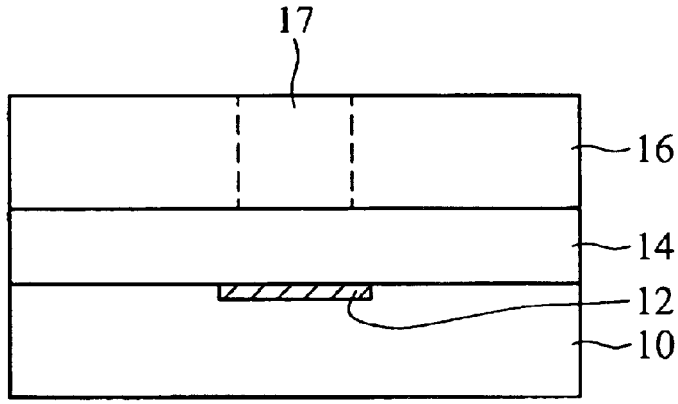

Next, in FIG. 1B, the first film 14 is covered with a second film 16 by laminating or other deposition method. Preferably, the second film 16 is also a photosensitive polymeric material, such as epoxy, novolak, arcylate, polyimide, polyamide, or photosensitive polymer.

Figure 1C:
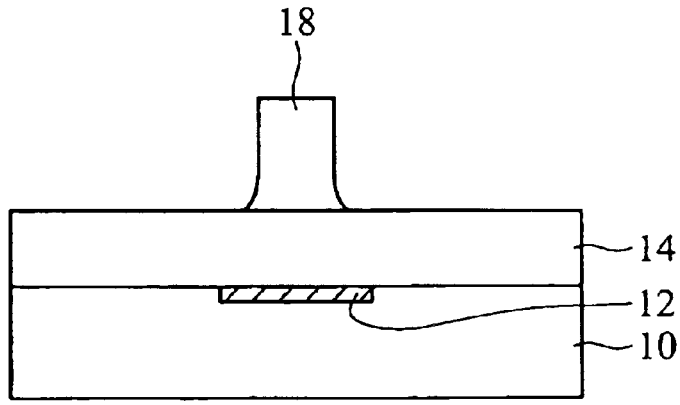

Next., in FIG. 1C, using exposure and development on a predetermined area of the second film 16, a convex portion 18 is formed on the surface of the first film 14. By controlling the degree of exposure, the side wall of the convex portion 18 cross-section is formed in an arc shape, as shown in FIG. 1C.

Figure 1D:
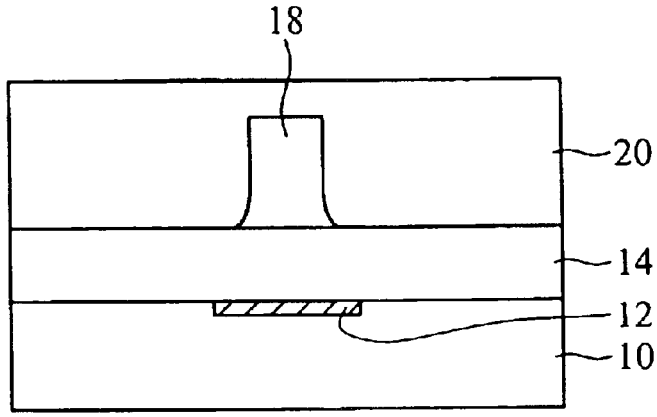

Next, in FIG. 1D, a third film 20 is formed on the exposed surface of the first film 14, covering the surface of the convex portion 18 by, for example, spin coating. The third film 20 is preferably made of spin-on-glass.

Figure 1E:
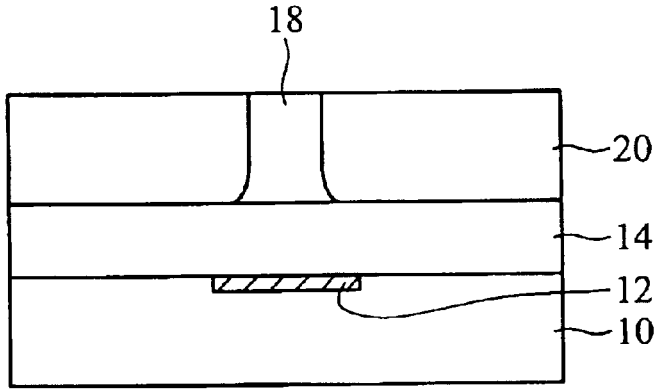

Next, in FIG. 1E, the third film 20 is dry-etched by, for example, plasma dry etching to remove part of the third film 20 and reveal the upper surface of the convex portion 18. In plasma dry etching, $CF_4$, $O_2$ or $SF_6$ are applied as the main etching gases.

Figure 1F:
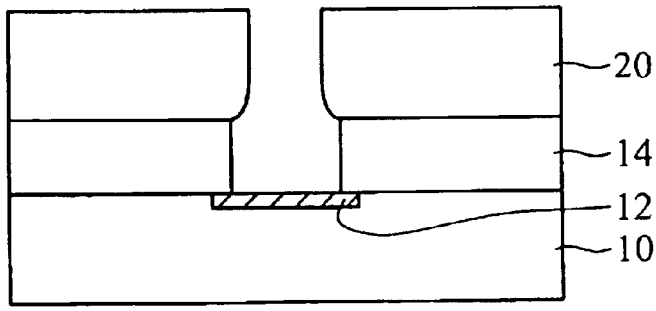

Next, in FIG. 1F, dry etching, for example, plasma dry etching is applied, with $O_2$ as the main etching gas and the third film 20 as the etching mask, to remove the convex portion 18 and the first film 14 thereunder, forming a via corresponding to the activated device 12, passing through the third film 20 and the first film 14. The via serves as a nozzle orifice of the present invention.

Second Embodiment

Figure 2A:
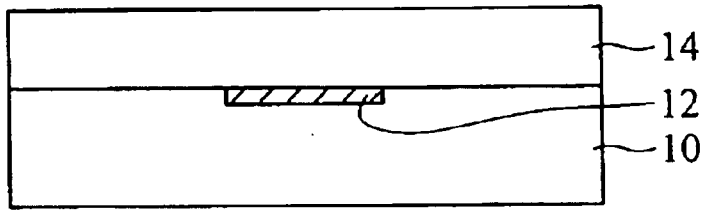
FIGS. 2A to 2F are sectional diagrams of a self-aligned fabrication process for a nozzle plate of an inkjet print head according to the second embodiment.

FIGS. 2A to 2F are sectional diagrams of a self-aligned fabrication process for a nozzle plate of an inkjet print head according to the second embodiment. In FIG. 2A, a silicon substrate 10 is provided with at least one activated device 12, such as a thin-film heater, and then covered with a first film 14 by laminating or any other deposition type. Preferably, the first film 14 is a photosensitive polymeric material, such as epoxy, novolak, arcylate, polyimide, polyamide, or photosensitive polymer.

Figure 2B:
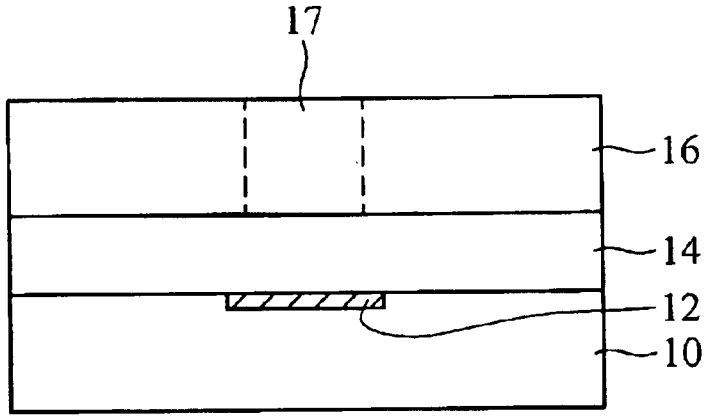

Next, in FIG. 2B, the first film 14 is covered with a second film 16 by laminating or other deposition method. Preferably, the second film 16 is also a photosensitive polymeric material, such as epoxy, novolak, arcylate, polyimide, polyamide, or photosensitive polymer.

Figure 2C:
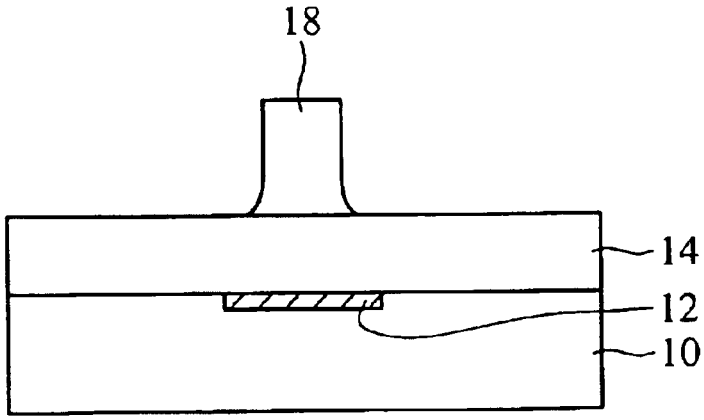

Next, in FIG. 2C, using exposure and development on a predetermined area of the second film 16, a convex portion 18 is formed on the surface of the first film 14. By controlling the degree of exposure, the side wall of the convex portion 18 cross-section is formed in an arc shape, as shown in FIG. 1C.

Figure 2D:
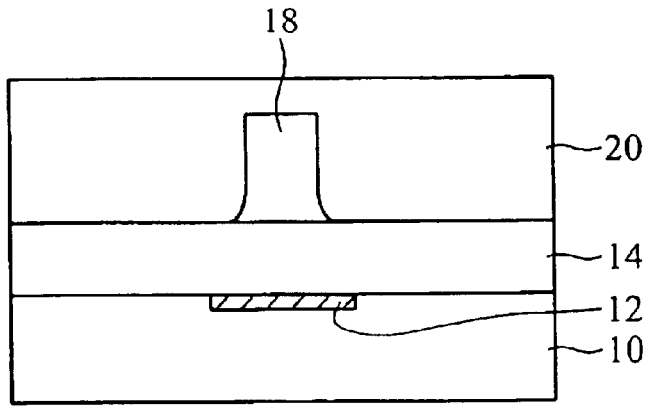

Next, in FIG. 2D, a third film 20 is formed on the exposed surface of the first film 14, covering the surface of the convex portion 18 by, for example, spin coating. The third film 20 is preferably made of spin-on-glass.

Figure 2E:
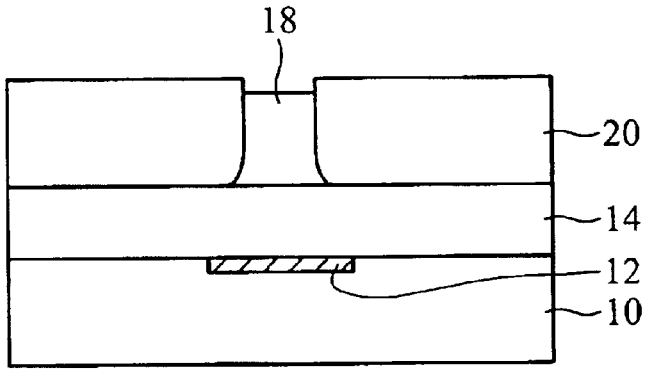

Next, in FIG. 2E, a part of the third film 20 covering the upper surface of the convex portion 18 is removed by photolithography to reveal the upper surface of the convex portion 18.

Figure 2F:
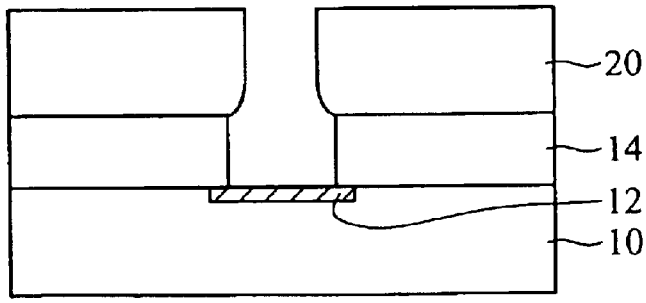

Next, in FIG. 2F, dry etching, for example, plasma dry etching is performed, with $O_2$ as the main etching gas and the third film 20 as the etching mask, to remove the convex portion 18 and the first film 14 thereunder, forming a via corresponding to the activated device 12, passing through the third film 20 and the first film 14. The via serves as a nozzle orifice of the present invention.

Compared with conventional nozzle plates formed using electroforming, the present invention employs laminating, photolithography and etching to form the nozzle orifice in the third film 20 and first film 14. The diameter of the nozzle orifice can be narrowed to approximately 1 $\mu$m and the number of the nozzle orifices in one row can reach more than 10000, thus increasing the density of the nozzle orifice pattern. Also, by directly forming nozzle orifices on the substrate 10, the conventional requirement of precise alignment between the nozzle orifices (on the metal nozzle plate) and the activated devices (on the substrate) in an electroforming step is avoided, and yield down resulting from misalignment is prevented. Moreover, the arrangement of adjacent nozzle orifices can be effectively controlled; by appropriately selecting the materials of the first film 14 and the third film 20 to be hydrophilic and hydrophobic respectively, the inkjet printing mechanism is facilitated, providing high-resolution inkjet performance. Furthermore, since photolithography and etching are directly performed on the substrate 10 and only easily controllable steps (e.g. isotropic dry etching) are involved, procedure is thus simplified, process costs are lowered, and commercialized mass production is enabled.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A self-aligned fabrication process for a nozzle plate of an inkjet print head, comprising the steps of:

providing a substrate having at least one activated device thereon;

forming a first film on the substrate;

forming a second film on the first film;

defining the second film to form a convex portion corresponding to the activated device, exposing a part of the surface of the first film;

forming a third film on the exposed surface of the first film, covering the convex portion;

removing the third film on the convex portion; and etching the convex portion and the first film under the convex portion to form a via.

2. The self-aligned fabrication process for a nozzle plate of an inkjet print head as claimed in claim 1, wherein the substrate is a silicon substrate.

3. The self-aligned fabrication process for a nozzle plate of an inkjet print head as claimed in claim 1, wherein the third film is made of spin-on-glass.

4. The self-aligned fabrication process for a nozzle plate of an inkjet print head as claimed in claim 1, wherein the third film on the convex portion is removed by etching to expose the surface of the convex portion.

5. The self-aligned fabrication process for a nozzle plate of an inkjet print head as claimed in claim 1, wherein the third film on the convex portion is removed by photolithography.

6. The self-aligned fabrication process for a nozzle plate of an inkjet print head as claimed in claim 1, wherein the via is formed by plasma dry etching.

7. The self-aligned fabrication process for a nozzle plate of an inkjet print head as claimed in claim 6, wherein the plasma dry etching uses oxygen as a main etching gas.

8. The self-aligned fabrication process for a nozzle plate of an inkjet print head as claimed in claim 1, wherein the first film is a polymer film.

9. The self-aligned fabrication process for a nozzle plate of an inkjet print head as claimed in claim 1, wherein the second film is a polymer film.

10. The self-aligned fabrication process for a nozzle plate of an inkjet print head as claimed in claim 1, wherein the activated device is a thin-film heater.

11. A self-aligned fabrication process for a nozzle plate of an inkjet print head, comprising the steps of:

providing a silicon substrate having at least one activated device thereon;

forming a first film on the substrate;

forming a second film on the first film;

defining the second film to form a convex portion corresponding to the activated device, exposing a part of the surface of the first film;

forming a spin-on-glass film on the exposed surface of the first film, covering the convex portion;

removing the spin-on-glass film on the convex portion; and etching the convex portion and the first film under the convex portion to form a via.

12. The self-aligned fabrication process for a nozzle plate of an inkjet print head as claimed in claim 11, wherein the spin-on-glass film on the convex portion is removed by etching to expose the surface of the convex portion.

13. The self-aligned fabrication process for a nozzle plate of an inkjet print head as claimed in claim 11, wherein the spin-on-glass film on the convex portion is removed by photolithography.

14. The self-aligned fabrication process for a nozzle plate of an inkjet print head as claimed in claim 11, wherein the via is formed by plasma dry etching.

15. The self-aligned fabrication process for a nozzle plate of an inkjet print head as claimed in claim 14, wherein the plasma dry etching uses oxygen as a main etching gas.

16. The self-aligned fabrication process for a nozzle plate of an inkjet print head as claimed in claim 11, wherein the first film is a polymer film.

17. The self-aligned fabrication process for a nozzle plate of an inkjet print head as claimed in claim 11, wherein the second film is a polymer film.

18. The self-aligned fabrication process for a nozzle plate of an inkjet print head as claimed in claim 11, wherein the activated device is a thin-film heater.

* * * * *